US009234626B2

(12) United States Patent
Simmons et al.

(10) Patent No.: US 9,234,626 B2
(45) Date of Patent: Jan. 12, 2016

(54) CONFORMABLE PRESSURE VESSEL FOR HIGH PRESSURE GAS STORAGE

(71) Applicants: Kevin L. Simmons, Kennewick, WA (US); Kenneth I. Johnson, Richland, WA (US); Curt A. Lavender, Richland, WA (US); Norman L. Newhouse, Lincoln, NE (US); Brian C. Yeggy, Lincoln, NE (US)

(72) Inventors: Kevin L. Simmons, Kennewick, WA (US); Kenneth I. Johnson, Richland, WA (US); Curt A. Lavender, Richland, WA (US); Norman L. Newhouse, Lincoln, NE (US); Brian C. Yeggy, Lincoln, NE (US)

(73) Assignee: BATTELLE MEMORIAL INSTITUTE, Richland, WA (US)

( * ) Notice: Subject to any disclaimer, the term of this patent is extended or adjusted under 35 U.S.C. 154(b) by 0 days.

(21) Appl. No.: 14/517,028

(22) Filed: Oct. 17, 2014

(65) Prior Publication Data

US 2015/0114975 A1 Apr. 30, 2015

Related U.S. Application Data

(60) Provisional application No. 61/896,482, filed on Oct. 28, 2013.

(51) Int. Cl.

| | |
|---|---|
| ***F17C 1/08*** | (2006.01) |
| ***B21D 26/021*** | (2011.01) |
| ***B21D 51/18*** | (2006.01) |

(52) U.S. Cl.

CPC ..... *F17C 1/08* (2013.01); *B21D 26/021* (2013.01); *B21D 51/18* (2013.01); *F17C 2201/0152* (2013.01); *F17C 2201/0161* (2013.01); *F17C 2203/013* (2013.01); *F17C 2209/2127* (2013.01); *F17C 2221/033* (2013.01)

(58) Field of Classification Search

CPC ..... F17C 2203/013; F17C 2201/0161; F17C 2201/0171; F17C 1/08; B21D 51/18

See application file for complete search history.

(56) References Cited

U.S. PATENT DOCUMENTS

| | | | | |
|---|---|---|---|---|
| 4,840,282 | A | 6/1989 | Gerhard | |
| 4,946,056 | A | 8/1990 | Stannard | |
| 5,323,953 | A * | 6/1994 | Adderley et al. | 228/157 |
| 5,462,193 | A | 10/1995 | Schoo | |
| 5,564,587 | A | 10/1996 | Falk et al. | |
| 5,577,630 | A | 11/1996 | Blair et al. | |
| 5,647,503 | A * | 7/1997 | Steele et al. | 220/589 |
| 5,758,796 | A | 6/1998 | Nishimura et al. | |
| 5,758,976 | A | 6/1998 | Lause et al. | |
| 2005/0150265 | A1 | 7/2005 | Kim et al. | |

OTHER PUBLICATIONS

Cheng, J -H., The determination of material parameters from superplastic inflation tests, Journal of Materials Processing Technology, 58, 1996, 233-246.

He, Z -B., et al., Mechanical properties and formability of TA2 extruded tube for hot metal gas forming at elevated temperature, Trans Nonferrous Met. Soc. China, 22, 2012, s479-s484.

Setlock, R. J. Jr., Thesis Dissertation, Hydrostatic Pressure Retainment, Ohio State University, Jun. 2004.

Gueskens, F., Thesis Dissertatio, Conformable Pressurized Structures; Design and Analysis, Technische Universiteit Delft, Nov. 2012.

* cited by examiner

*Primary Examiner* — Stephen Castellano

(74) *Attorney, Agent, or Firm* — A. J. Gokcek

(57) ABSTRACT

A non-cylindrical pressure vessel storage tank is disclosed. The storage tank includes an internal structure. The internal structure is coupled to at least one wall of the storage tank. The internal structure shapes and internally supports the storage tank. The pressure vessel storage tank has a conformability of about 0.8 to about 1.0. The internal structure can be, but is not limited to, a Schwarz-P structure, an egg-crate shaped structure, or carbon fiber ligament structure.

14 Claims, 20 Drawing Sheets

Sample #1

Sample #2

Sample #3

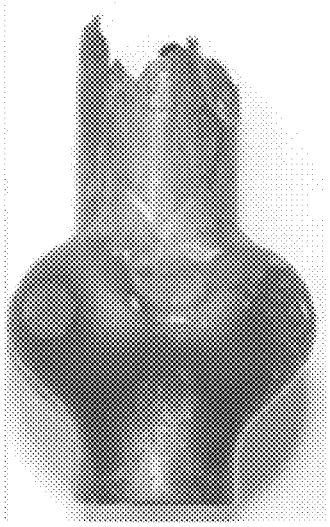
Sample #4
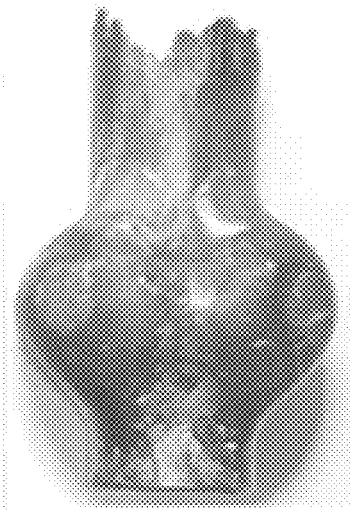
Sample #5
Figure 5D
Figure 5E

| Internal Volume, L | 89L | 89L | 89L | 89L | 89L | 89L | 100L | 100L | 100L | 100L | 100L | 100L |
|---|---|---|---|---|---|---|---|---|---|---|---|---|
| Pressure, Mpa | 5 | 10 | 25 | 5 | 10 | 25 | 5 | 10 | 25 | 5 | 10 | 25 |
| X x Y x Z Cells | 4x8x16 | 4x8x16 | 4x8x16 | 4x8x32 | 4x8x32 | 4x8x32 | 4x8x16 | 4x8x16 | 4x8x16 | 4x8x32 | 4x8x32 | 4x8x32 |
| Conformability | 0.96 | 0.96 | 0.96 | 0.98 | 0.98 | 0.98 | 0.96 | 0.96 | 0.96 | 0.98 | 0.98 | 0.98 |
| Usable Vol Frac. | 0.84 | 0.77 | 0.61 | 0.87 | 0.80 | 0.65 | 0.84 | 0.77 | 0.61 | 0.87 | 0.80 | 0.65 |
| Tank Mass, Kg | 35.4 | 70.7 | 176.8 | 28.9 | 57.9 | 144.7 | 39.7 | 79.5 | 198.7 | 32.5 | 65.0 | 162.6 |
| Tank Matl. Vol, L | 13.3 | 26.6 | 66.5 | 10.9 | 21.8 | 54.4 | 14.9 | 29.9 | 74.7 | 12.2 | 24.4 | 61.1 |
| Matl. Thickness, mm | 2.7 | 5.5 | 13.7 | 1.4 | 2.7 | 6.8 | 2.8 | 5.7 | 14.2 | 1.4 | 2.8 | 7.1 |
| Cell Size, cm | 5.9 | 6.2 | 7.0 | 2.9 | 3.0 | 3.4 | 6.2 | 6.4 | 7.3 | 3.0 | 3.1 | 3.5 |
| SchwarzP ID, mm | 26.8 | 25.3 | 21.3 | 13.2 | 12.4 | 10.0 | 27.9 | 26.3 | 22.1 | 13.8 | 12.9 | 10.4 |
| Ext. Vol, Liters | 102.3 | 115.6 | 168.8 | 99.9 | 110.8 | 154.3 | 114.9 | 129.9 | 189.6 | 112.2 | 124.4 | 173.3 |
| Total Vol, Liters | 106.0 | 123.1 | 174.2 | 102.0 | 114.9 | 153.8 | 119.2 | 138.3 | 195.8 | 114.6 | 129.1 | 172.8 |

Figure 8

CONFORMABLE PRESSURE VESSEL FOR HIGH PRESSURE GAS STORAGE

CROSS-REFERENCE TO RELATED APPLICATIONS

This application claims priority to U.S. Provisional Application Ser. No. 61/896,482, filed Oct. 28, 2013, titled "CONFORMABLE PRESSURE VESSEL FOR HIGH PRESSURE GAS STORAGE," hereby incorporated by reference in its entirety for all of its teachings.

STATEMENT REGARDING FEDERALLY SPONSORED RESEARCH OR DEVELOPMENT

The invention was made with Government support under Contract DE-AC05-76RLO1830, awarded by the U.S. Department of Energy. The Government has certain rights in the invention.

TECHNICAL FIELD

This invention relates to pressure vessels. More specifically, this invention relates to a conformable and non-cylindrical pressure vessel storage tank.

BACKGROUND OF THE INVENTION

Current state-of-the-art compressed natural gas (CNG) storage has been limited to high pressure gas cylinders, with the most common being Type 1 tanks, which are made from high strength steels. High pressures of 250 bar for CNG powered vehicles are necessary to achieve the required gas volume for typical vehicle mileage between refueling. Hydrogen storage vehicles have been designed for 350 and 700 bar and are primarily of Type 3 and Type 4 pressure vessels. Moving to higher storage pressures to improve volumetric energy density is challenged by disproportionately higher tank costs in vehicles where space usage is a premium.

SUMMARY OF THE INVENTION

The present invention is directed to non-cylindrical pressure vessel storage tanks and methods of making non-cylindrical pressure vessel storage tanks. In one embodiment, a non-cylindrical pressure vessel storage tank is disclosed. The pressure vessel storage tank includes an internal structure coupled to an inner surface of the storage tank. The internal structure helps shape and internally supports the storage tank. The pressure vessel storage tank has conformability in the range of about 0.8 to about 1.0. Using compressed natural gas storage as an example, with density approximately 0.184 kg/L, specific energy approximately 9.2 MJ/L at approximately 25 MPa and approximately 15° C., the pressure vessel storage tank has a gravimetric energy density of approximately 8.0 MJ/kg or greater, and a volumetric energy density of approximately 5.8 MJ/L or greater. Independent of contents—an empty tank—the tank designed for a rated pressure of approximately 25 MPa has a gravimetric efficiency of approximately 1 L/kg (stored volume divided by tank mass) or greater; and a volumetric efficiency of approximately 4.6 $L_{(storage)}/L_{(material)}$ or greater.

The internal structure may be, but is not limited to, a reinforcement structure. The internal structure may also be designed and used to control temperature and/or heat transfer with the contents within the tank.

In one embodiment, the reinforcement structure is a high surface area to volume structured shape or a carbon fiber ligament structure.

In one embodiment, the high surface area to volume structure is a Schwarz-P structured shape or an egg-crate shaped structure.

In one embodiment, the Schwarz-P structured shape is capped as an internal reinforcement lattice.

In one embodiment, the carbon fiber ligament structure spans the interior of the tank in three dimensions.

The pressure vessel storage tank stores at least one of the following: compressed natural gas (CNG), hydrogen, chemical energy, or compressed energy.

The internal structure is made of, but not limited to, one or more of the following materials: metals, polymers, composites, and combinations thereof.

The pressure vessel storage tank has a rated pressure of up to about 250 bar with 90% or greater conformability and can withstand internal pressures from about 350 bar to about 750 bar.

In another embodiment of the present invention, a method of making an internal structure for a non-cylindrical pressure vessel storage tank is disclosed. The method comprises: providing a die having a series of cavities, wherein each die cavity is independently temperature controlled; affixing a tube on one end of the die; applying hot gas under high pressure as the tube is fed into the die to form rows of cells; and diffusion bonding or brazing cell rows together to form the internal structure.

In another embodiment of the present invention, a method of making an internal structure for a non-cylindrical pressure vessel storage tank is disclosed. The method comprises: providing a multi-sheet pack with punched in holes; welding patterns around the holes of the multi-sheet pack; and applying gas pressure and temperature to expand the welded multi-sheet pack.

In another embodiment of the present invention, a method of making an internal structure for a non-cylindrical pressure vessel storage tank is disclosed. The method comprises: providing an attachment for a carbon fiber ligament to affix to an inner surface of the tank; affixing the carbon fiber ligament to the attachment to the tank inner surface; joining the attachment to a surface of the internal structure by one or more of following: laser welding, diffusion bonding, brazing, friction stir, e-beam welding, and stamping; joining carbon fiber tows to the attachment; joining a perimeter of the tank outside surface; and expanding the surface to a final tank geometry and tensioning the carbon fiber ligament.

BRIEF DESCRIPTION OF THE DRAWINGS

FIGS. 5A-5E show the forming characteristics of several conformable pressure vessel storage tank samples with various times, temperatures, pressure, and end feed lengths, in accordance with one embodiment of the present invention.

FIG. 8 is a table illustrating volume and mass of an aluminum conformable Schwarz-P reinforced rectangular storage tank as a function of internal pressure.

DETAILED DESCRIPTION OF THE PREFERRED EMBODIMENTS

The present invention is directed to non-cylindrical pressure vessel storage tanks and methods of making non-cylindrical pressure vessel storage tanks. The present invention solves the ability to shape a pressure vessel storage tank and internally support outer surfaces of the tanks through one or more internal structures holding the surface in a desired configuration. Without the internal structure, the pressure vessel tank would want to form into a sphere-like shape which would likely burst before reaching that shape. In certain embodiments, the internally strengthened structures have a minimal surface area to volume ratio.

The present invention also discloses conformable pressure vessel storage tanks and support structures with cost-efficient manufacturing methods that keep costs down. Conformability is defined as the external tank volume divided by the volume of the rectangular box that would contain it. As examples, a sphere has a conformability factor of 0.52, whereas a typical compressed gas cylinder with length-to-diameter ratio of 4 has a conformability ratio of 0.72. The conformable tank designs of the present invention also increase the space efficiency of storing CNG or other high pressure gas onboard a vehicle or in a device.

Figure 1:
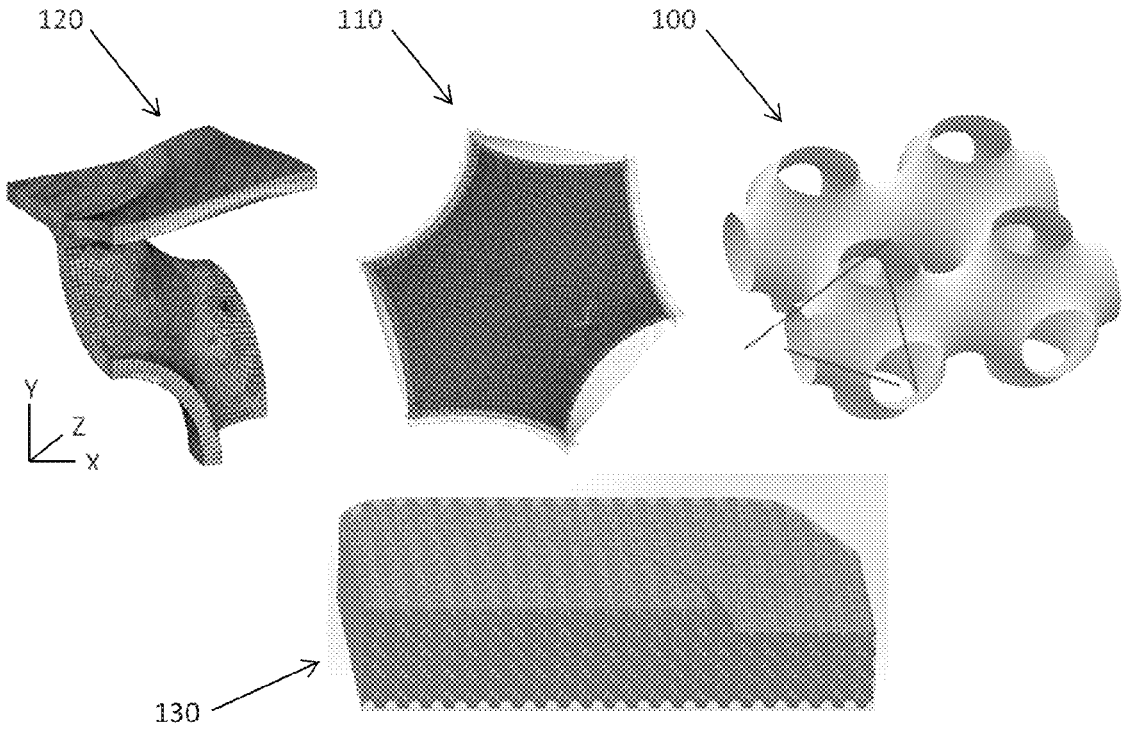
FIG. 1 shows a Schwarz-P minimal surface structure as an internal reinforcement structure to support a conformable external pressure boundary, in accordance with one embodiment of the present invention.

FIG. 1 shows a Schwarz-P minimal surface structure 100 as an internal reinforcement lattice to support a conformable external pressure boundary of a conformable pressure vessel storage tank, in accordance with one embodiment of the present invention. Also shown in FIG. 1 is a Schwarz-P repeating sub-element 110, a sub-element with a pressure membrane 120, and a cross-section view of the conformable tank in a spare tire well 130. Finite element analysis was used to size the thickness of the internal and external structure to withstand a 250 bar internal pressure. The mass of the sub-cell structure shown in FIG. 1 was scaled to a 140 L capacity tank. Based on the high strength to weight ratio of commercial titanium sheet metal and tubing, the estimated tank mass is low enough to nearly meet the specific energy target (11.9 vs. 12 MJ/kg).

Figure 2A:
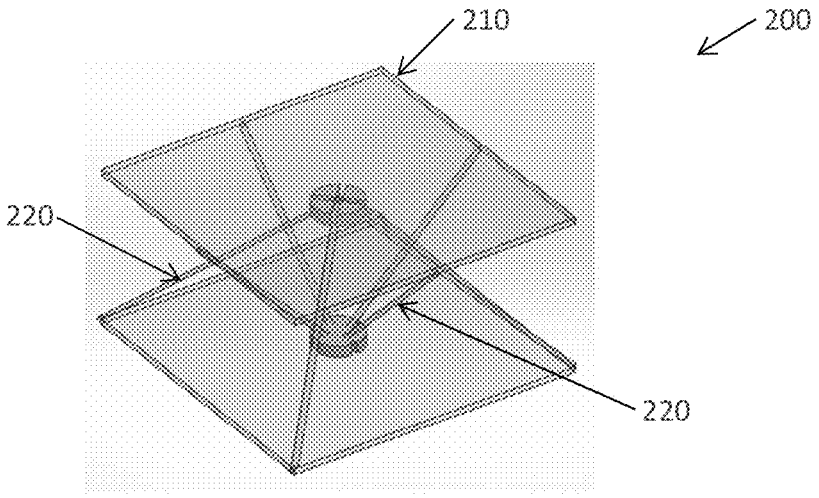
FIGS. 2A and 2B show carbon fiber ligaments spanning the interior of a pressure vessel storage tank to support the conformable pressure boundary.
Figure 2B:
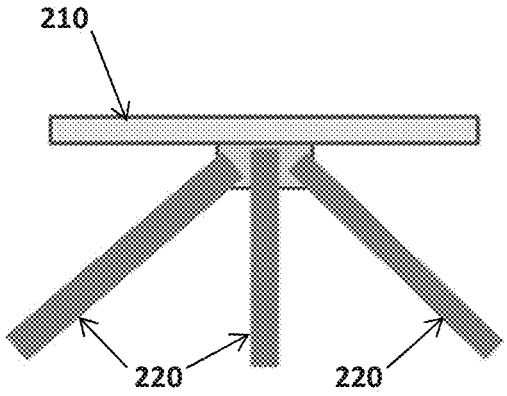

FIGS. 2A and 2B show carbon fiber ligaments 220 spanning the interior of a pressure vessel storage tank 200 to support the conformable pressure boundary. In one embodiment, the ligaments 220 are coupled to an outer tank wall 210. Due to the superior strength to weight ratio of carbon fiber compared to other metals, this tank design can achieve a specific energy density greater than 12 MJ/kg.

Figure 3A:
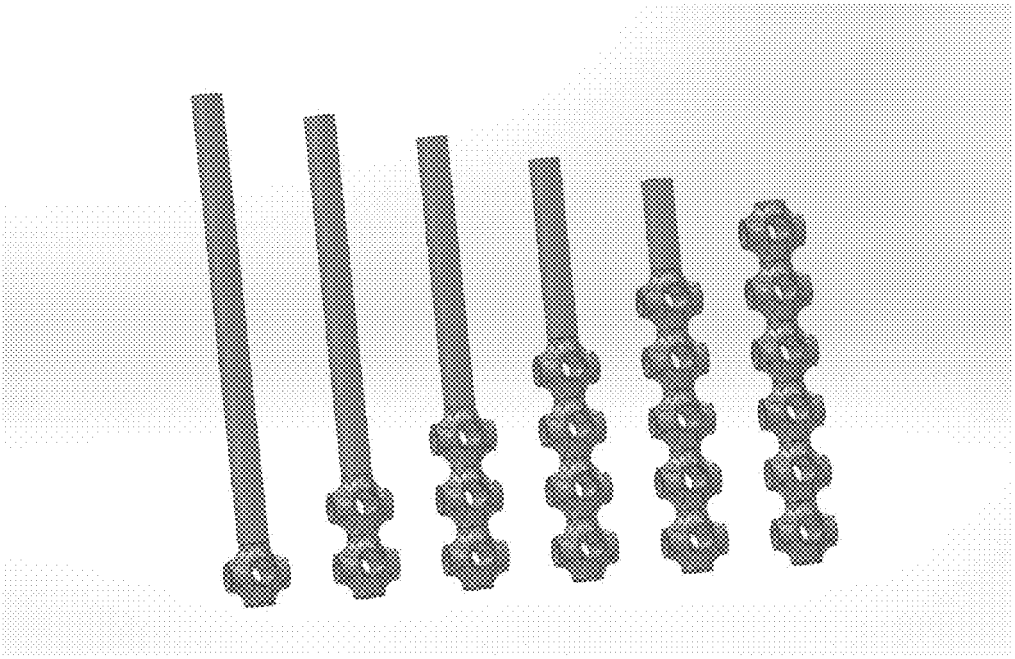
FIG. 3A shows blow forming rows of Schwarz-P cells from tubing, in accordance with one embodiment of the present invention.
Figure 3B:
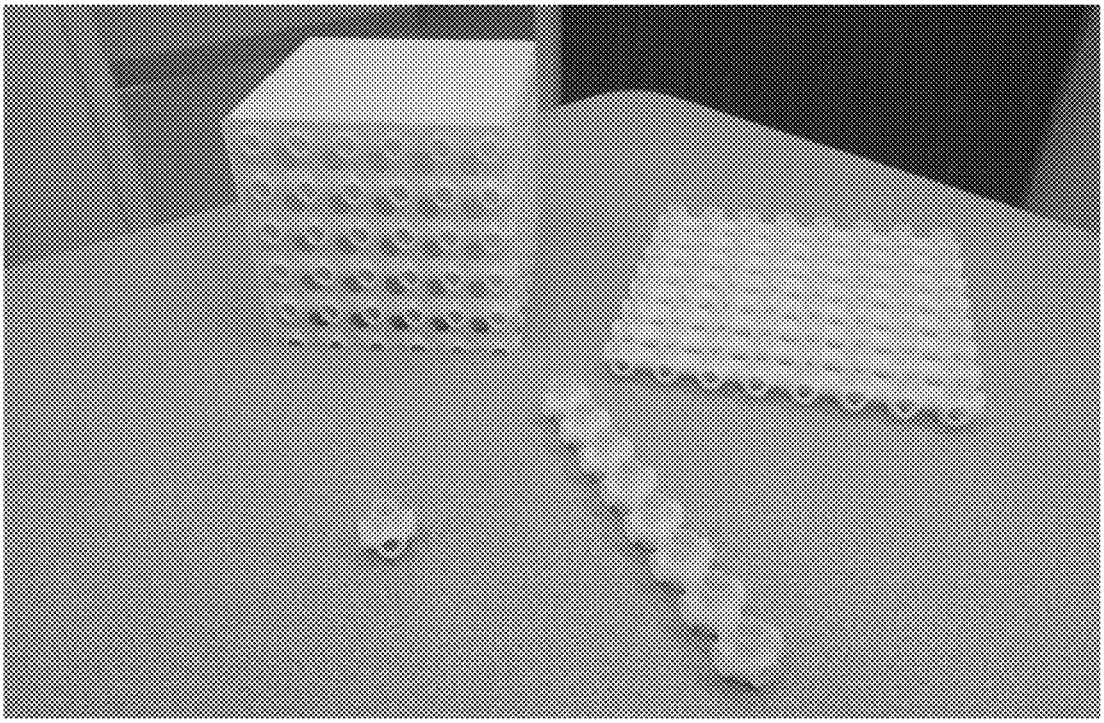
FIG. 3B shows a three-dimensional structure of the Schwarz-P cells formed by diffusion bonding or brazing of the cell rows together from FIG. 3A.

Several embodiments of making an internal structure for a non-cylindrical pressure vessel storage tank are disclosed herein. One embodiment involves hot blow forming rows of Schwarz-P cells from tubing, as shown in FIG. 3A, followed by diffusion bonding or brazing of the rows of cells into a three-dimensional lattice structure, as shown in FIG. 3B. Finite element analysis was used to model the blow forming process and the stresses in the formed part at approximately 250 bar operating pressure. The model was sized for a 35 L tank with an 8×16×32 cell structure, although other tank volumes and cell structures may be used. The unit cell size, in this example embodiment, was 2.14 cm.

Figure 4A:
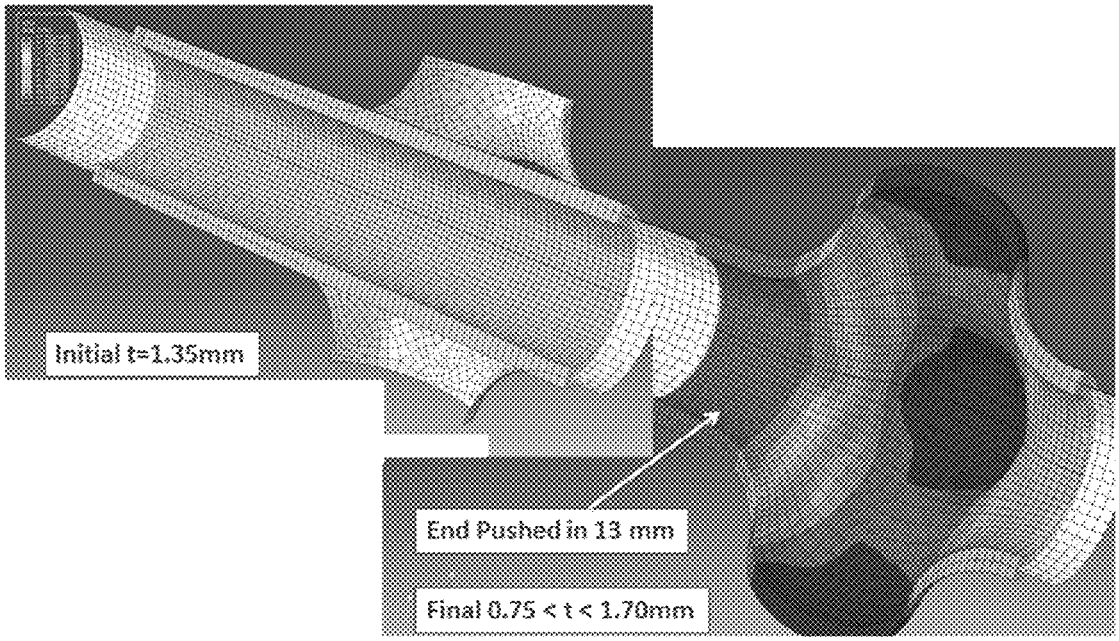
FIG. 4A shows how axial tube compression can be used to feed additional metal into the die to control the final thickness of the blow formed Schwarz-P structure, in accordance with one embodiment of the present invention.
Figure 4B:
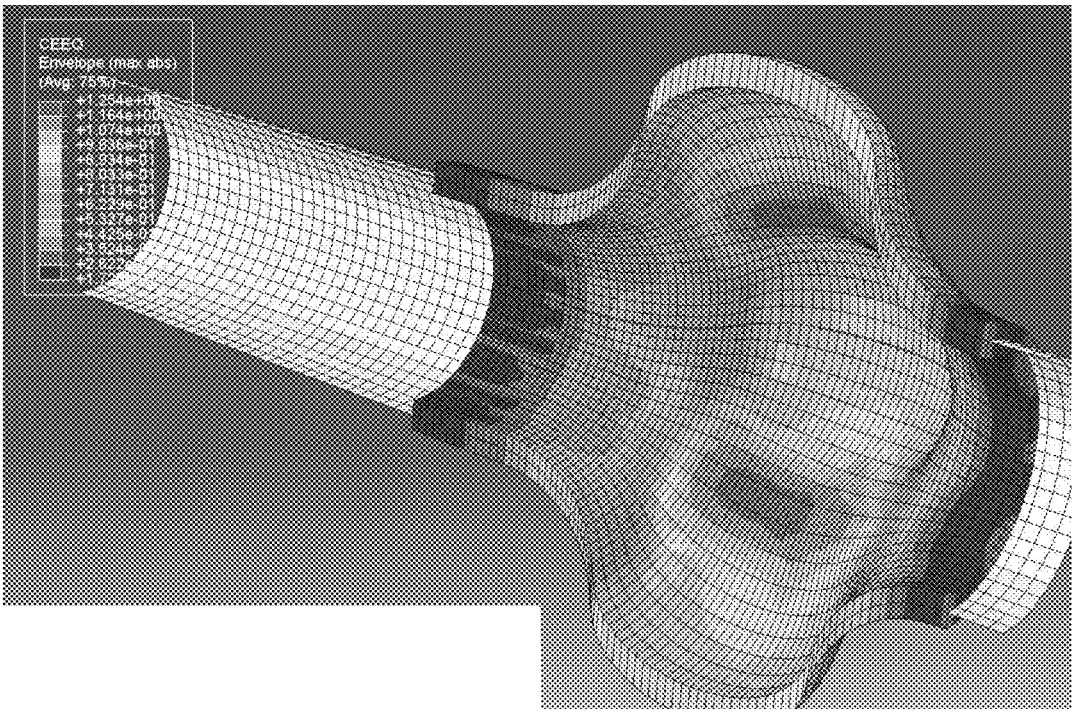
FIG. 4B shows an equivalent strain contour plot of the blow formed Schwarz-P structure, in accordance with one embodiment of the present invention.

In the above examples, the average tube diameter was approximately 10.7 mm and the initial tube wall thickness was varied to achieve acceptable stresses at approximately 250 bar pressure in the final formed state. Analyses were performed with and without compressive end force to show the difference in the formed thickness distribution. FIG. 4A shows how axial tube compression can be used to feed additional metal into the die to control the final thickness variation in the part. The tube was compressed about 13 mm as the internal pressure was increased from about 1 to about 3.8 MPa. Final forming was then achieved by holding the end feed constant while increasing the pressure to about 4.6 MPa. With an initial wall thickness of approximately 1.35 mm, the model predicted that the final wall thickness will vary from about 0.75 mm to about 1.70 mm. FIG. 4B shows that the maximum equivalent strain was approximately 1.25 at the surface between the lobes and about 0.9 through-thickness in the thinnest areas. These strains are fully achievable using titanium tubing. In an alternative embodiment, the tube end was not compressed but drew in naturally about 7 mm as the tube expanded in the die. This resulted in a larger variation in tube wall thickness from about 0.42 mm to about 1.35 mm.

The final thickness distribution (of the 13 mm compressive end feed case) was mapped onto the unit cell geometry to calculate stresses in the formed part under operating pressure and higher autofrettage pressure loads. Comparing the stress plots at 25 MPa (250 bar) before and after the autofrettage step shows that the maximum stress is approximately the same, but local stress concentrations have generally been reduced. The initial tube thickness of 1.35 mm results in a variable thickness part with the same mass and similar stresses of the constant thickness Schwarz-P geometry described above. Therefore, even though the thickness is uneven, it is thick enough to resist the loads in the thinnest areas with the same mass as the uniform thickness part.

Another forming method, which will be discussed in further detail below, involves approximating the Schwarz-P structure by expanding a welded multi-sheet pack. This is similar to an egg-crate structure. The unit cell mass of the structure gives a specific energy of approximately 9.4 MJ/kg which is somewhat lower than the 11.9 MJ/kg of the Schwarz-P configuration. However, advantages of the expanded sheet forming method include, but are not limited to, the following: the potential to expand the entire tank structure as one unit; lower strains in this sheet bending and stretching operation; and lower forming time. Example steps in the multi-sheet blow forming process include but are not limited to: a) providing a multi-sheet pack with an alternating quilted pattern of punched in holes within the internal layers and solid top and bottom pressure boundary layers, b) welding around the hole pattern of the multi-sheet stack to connect all internal sheets together and to the external sheets, c) welding around the perimeter of the sheet pack to provide pressure containment, d) heating the pack to the forming pressure while applying a specified internal pressure to separate the layers, e) applying a specified increasing pressure within the sheet pack to expand the flat internal layers into an approximate Schwarz-P, egg-crate like shape and blow form the package into the desired conformal shape.

Different approaches have been developed for manufacturing conformal tanks using a Schwarz-P minimal-surface internal structure. One embodiment involves hot blow forming of the Schwarz-P cells from titanium tubing. An example of implementing this approach involves the following. Schwarz-P structures are created with hot gas forming equipment. The structures are welded together. Two sheets are formed to make an outer cover. The internal tubing structure is welded to the outer cover. The outer cover is welded together. A hole is cut in which a metal boss (for a screw-in and plug) is welded on. Burst tests are performed on at least 1 of approximately 200 tanks produced. Quality assurance is performed on the tank.

In another embodiment of manufacturing the tanks using Schwarz-P structures, multiple sheets of titanium are formed into egg-carton or egg-crate shapes and the sheets are welded together. An example of implementing this approach involves the following. A specimen or sample is heated in a furnace until the temperature reaches about 800-900° C. Sheets are stamped to shape. Holes are cut in each sheet. The sheets are welded by one to another. Outer sheets are formed for the tank skin (outer pressure boundary). An inner structure is placed inside the two halves of the tank skin. The inner structure is welded to the outer cover. The outer cover is welded together. Burst tests are performed on at least one of approximately 200 tanks produced. Quality assurance is performed on the tank.

Other equipment or tools can be substituted for the above approaches, and not all steps are required. For example, a hot-platen press can be used to form the egg-carton shaped alternative Schwarz-P structure in place of a furnace and stamping press.

Example of non-welded forming process. A hot gas forming tool was designed and fabricated. Testing of the die and forming process was completed. The data was used to correlate model estimates to the forming process and cost models. The forming tool was lower in temperature than the process model used for the prediction and the use of higher forming pressure of >4000 psi. The higher pressure and the in-feed speed of the tool met and exceeded forming times estimated for the cost model.

Two titanium tubing alloys were used in hot gas forming trials. The titanium alloy 3Al-2.5V has higher mechanical properties and three times higher yield strength at approximately 500° C. compared to commercially pure (CP) Ti of its yield stress of 12,600 psi. The tube geometry used for forming was 0.375" OD with a 0.035" wall thickness.

Figure 5A:
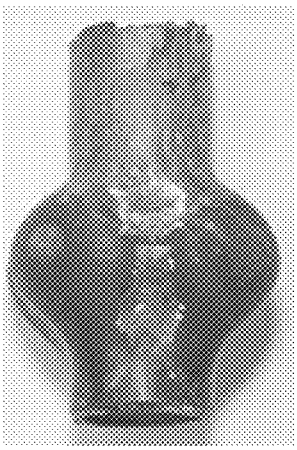
Figure 5B:
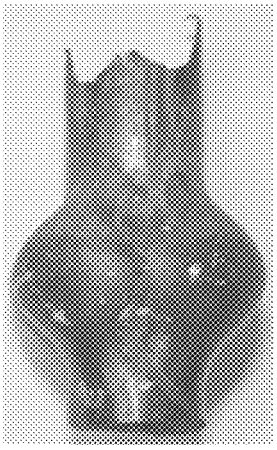
Figure 5C:
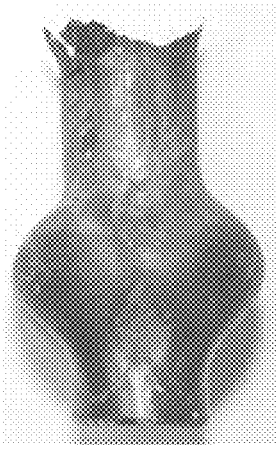
Figure 6:
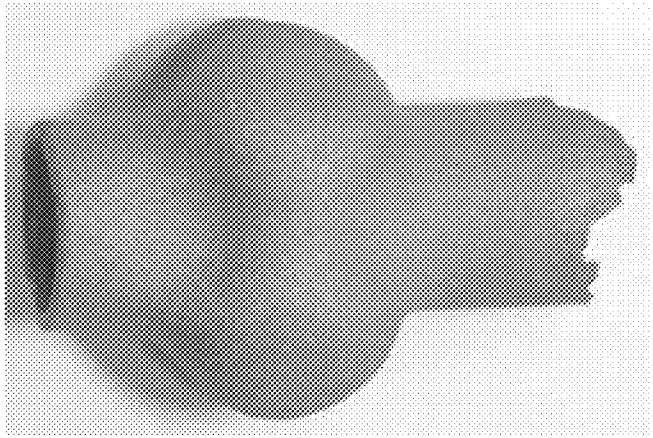
FIG. 6 illustrates the forming characteristic of a sample conformable pressure vessel tank at certain control variables, in accordance with one embodiment of the present invention.

The fabricated tool had cartridge heaters that reached a maximum temperature of approximately 625° C. The titanium tubes were inserted onto the ram in the center. The argon gas was turned on and the tool was closed. The end feeding ram was lowered until the bottom of the tube made a seal on the lower insert to pressurize the tube. The gas pressure was then increased up to approximately 4500 psi and end feeding began at a rate of 0.5 inches in 2 minutes. FIG. 5 illustrates the forming characteristics of various samples with various times, temperatures, pressures, end feed lengths. Sample #1 of FIG. 5A had a forming temperature of 1080° F., a forming pressure of 4200 psi, a form time of approximately 9 minutes, a total time of approximately 13 minutes, and an end feed length of approximately 0.5 inches. Sample #2 of FIG. 5B had a forming temperature of 1000° F., a forming pressure of 4500 psi, a form time of approximately 6 minutes, a total time of approximately 10 minutes, and an end feed length of approximately 0.5 inches. Sample #3 of FIG. 5C had a forming temperature of 1000° F., a forming pressure of 4400 psi, a form time of approximately 4 minutes, a total time of approximately 8 minutes, and an end feed length of approximately 0.5 inches. Sample #4 of FIG. 5D had a forming temperature of 1090° F., a forming pressure of 4000 psi, a form time of approximately 2 minutes, a total time of approximately 4 minutes, and an end feed length of approximately 0.6 inches. Sample #5 of FIG. 5E had a forming temperature of 1090° F., a forming pressure of 4300 psi, a form time of approximately 2 minutes, a total time of approximately 4 minutes, and an end feed length of approximately 0.55 inches. Sample numbers 4 and 5 demonstrate the ability to form the complex shape with a high level of plastic flow. FIG. 6 illustrates a sample Schwarz-P cell from which to construct a conformable pressure vessel tank at certain control variables and characteristics, in accordance with one embodiment of the present invention.

Figure 7:
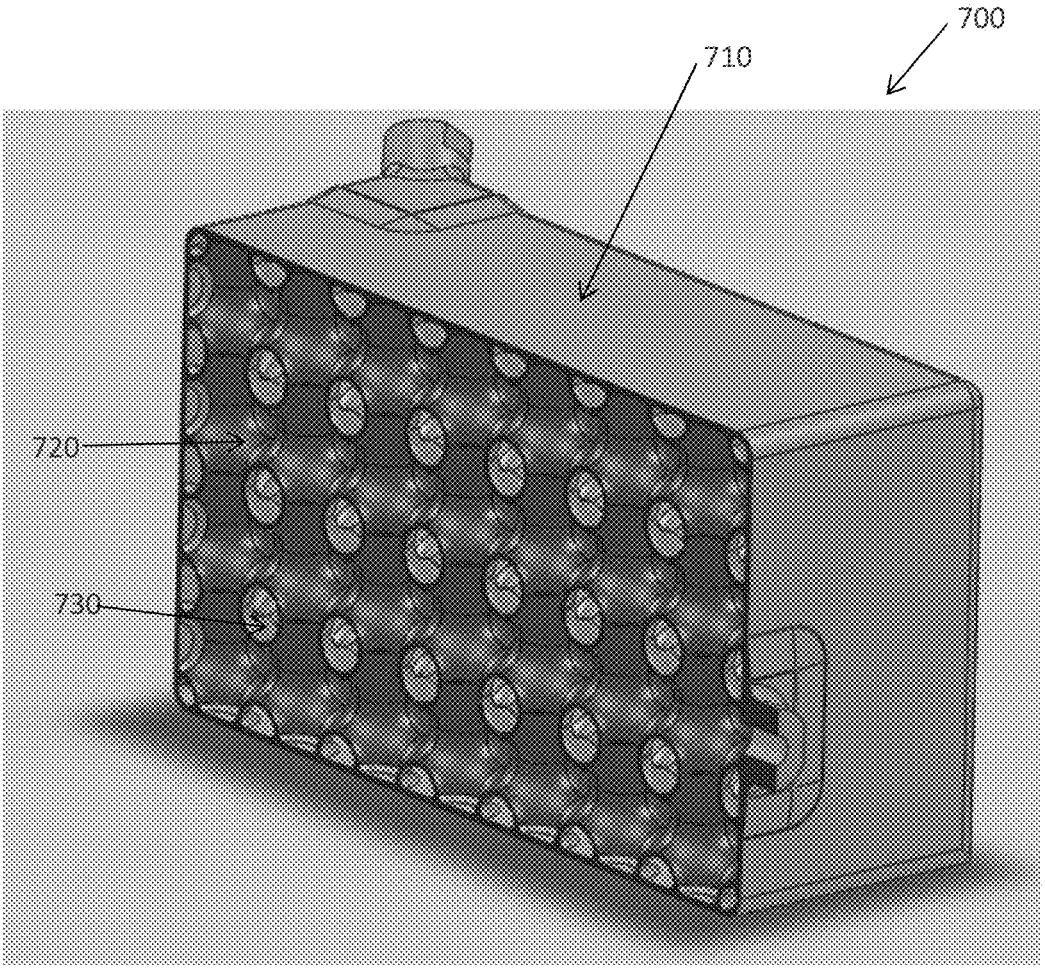
FIG. 7 is a schematic of a Schwarz-P reinforced pressure vessel storage tank including inlet and outlet bosses, in accordance with one embodiment of the present invention.

FIG. 7 is a schematic of a Schwarz-P reinforced pressure vessel storage tank 700 including inlet and outlet bosses, in accordance with one embodiment of the present invention. The tank 700 includes a pressure vessel wall 710, an outer pressure boundary surface 720 of the Schwarz-P structure, and an inner surface 730 of the Schwarz-P structure. In one embodiment, the volume of this tank for additive manufacturing was approximately 5 L.

FIG. 8 is a table that illustrates the impact pressure has on the mass of the tank using lower strength materials. The table also includes the cell density for increased conformability and how it can reduce weight by improved load sharing amongst the structure.

Figure 9A:
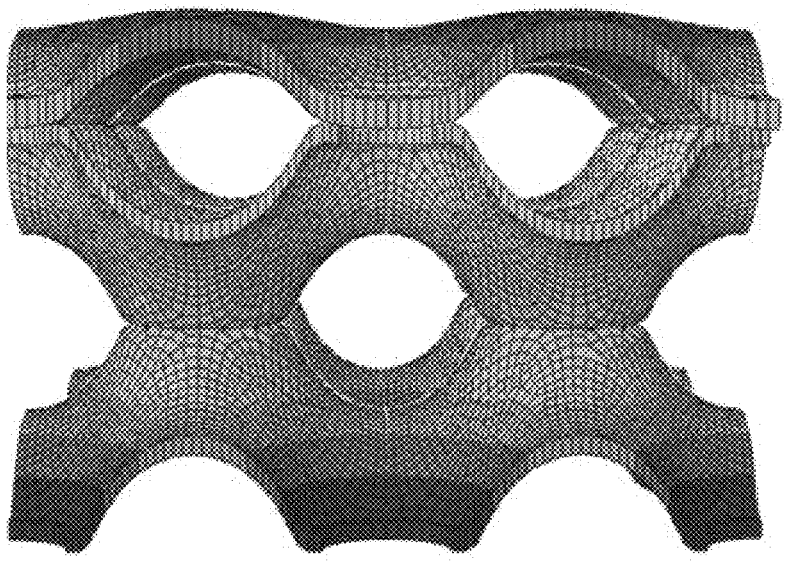
FIG. 9A illustrates a skip-weld pattern for a conformable storage tank that requires approximately one-half the number of welds, in accordance with one embodiment of the present invention.

FIG. 9A illustrates a skip-weld pattern for a conformable storage tank that produces approximately one-half the number of welds, in accordance with one embodiment of the present invention.

Figure 9B:
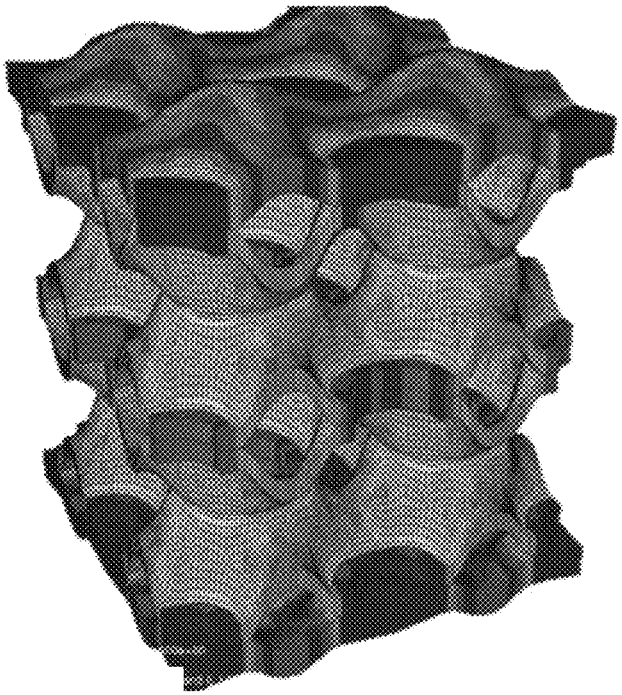
FIG. 9B illustrates a full-weld pattern for a conformable storage tank, in accordance with one embodiment of the present invention.

FIG. 9B illustrates a full-weld pattern for a conformable storage tank, in accordance with one embodiment of the present invention.

Figure 10:
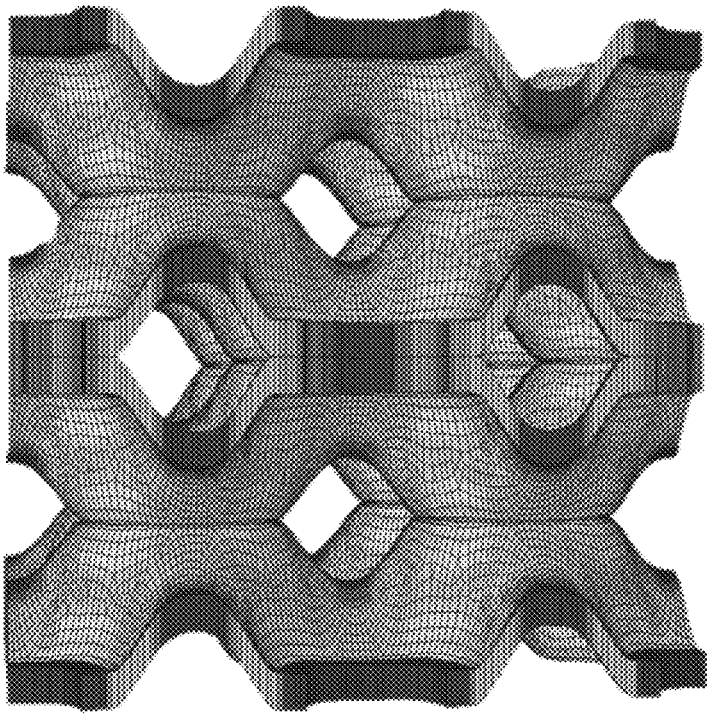
FIG. 10 shows the final geometry for a full-welded and formed pattern for a conformable storage tank, in accordance with one embodiment of the present invention.

FIG. 10 shows the final geometry for a full-welded and formed pattern for a conformable storage tank, in accordance with one embodiment of the present invention. The storage tank, in this example, had a true strain of about 1.5, an engineering strain of about 400-450%, and a unit cell size of approximately 20 mm.

Figure 11A:
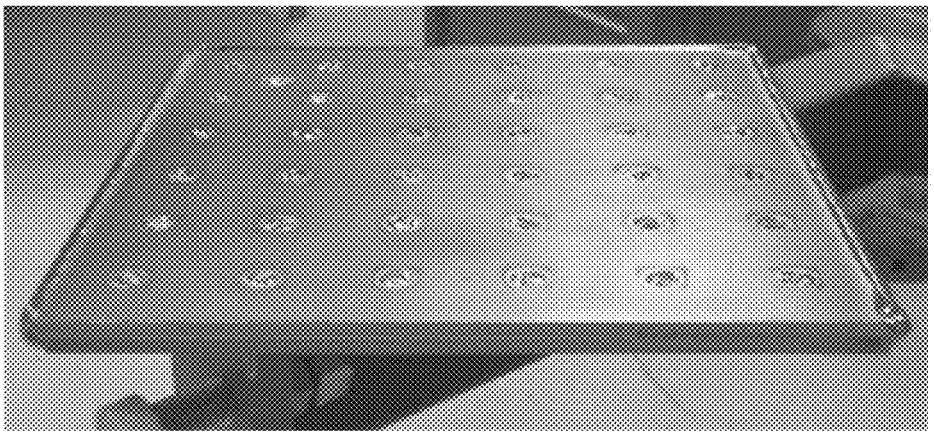
FIG. 11A shows a four-layer sheet pack weld design using a skip-weld pattern with 97 total welds for intermediate forming tests, in accordance with one embodiment of the present invention.
Figure 11B:
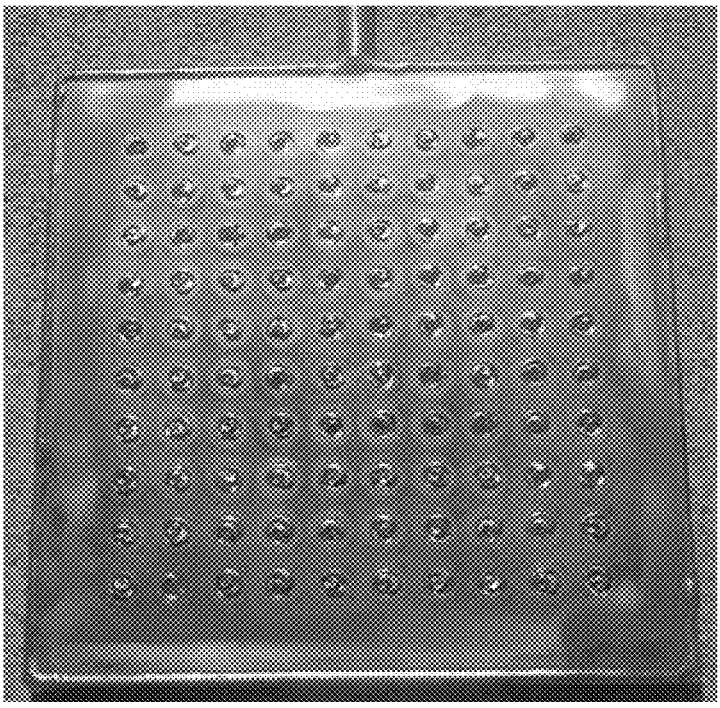
FIG. 11B shows a four-layer sheet pack with the same inner and outer material thickness of the design of FIG. 11A but using the full-weld pattern with 321 welds.

Sheet pack welding. In this example, three different 10 inch by 10 inch sheet pack weld designs were welded and tested. The first pack, as shown in FIG. 11A, used the skip-weld pattern and 4 sheets (97 total welds); two 0.080 inch thick inner layers and two $\frac{1}{8}^{th}$ inch thick outer layers. The second is a four layer sheet pack with the same inner and outer material thicknesses but using a full-weld pattern with 321 welds as shown in FIG. 11B. The third sheet pack also uses the full-weld pattern, but with two added inner layers of approximately 0.080 inch thick titanium (563 total welds). The four internal layers allow forming to a total separation of approximately 40 mm (~1.6 inch) between the outer sheets compared to approximately 20 mm (~0.8 inch) for the 2 inner layers of the 4 sheet packs.

Tank forming. A superplastic forming press was configured to specified forming conditions. The experimental conditions for the sheet packs were 925° C. and pressures up to 200 psi. The sheet packs were placed in the superplastic forming furnace, heated to 925 C, and allowed to soak for about 1 hour with 10 psi pressure to assist in plate separation to minimize the potential for the contacting sheets to diffusion bond together. The pressure was incrementally increased at 1 psi/min with argon during the superplastic blow forming step.

Figure 12A:
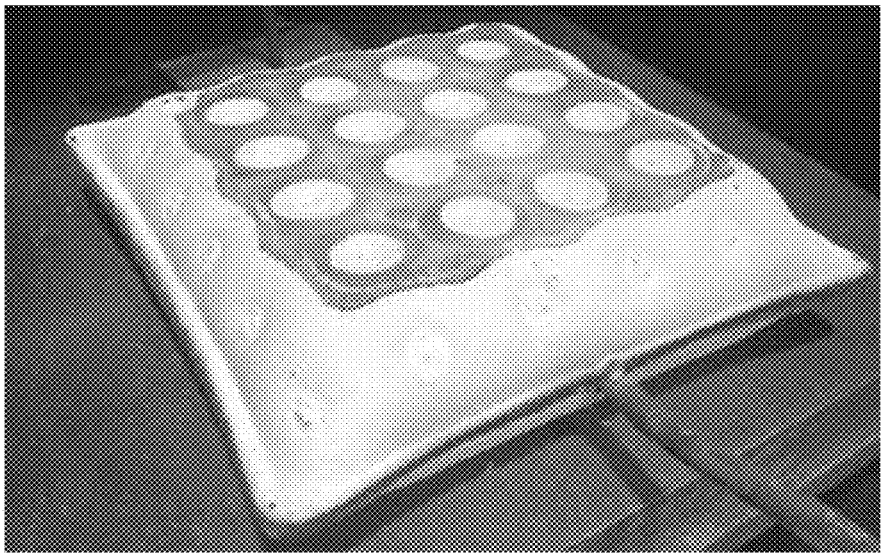
FIG. 12A shows a skip-weld sheet pack after forming of the conformable pressure vessel storage tank, in accordance with one embodiment of the present invention.
Figure 12B:
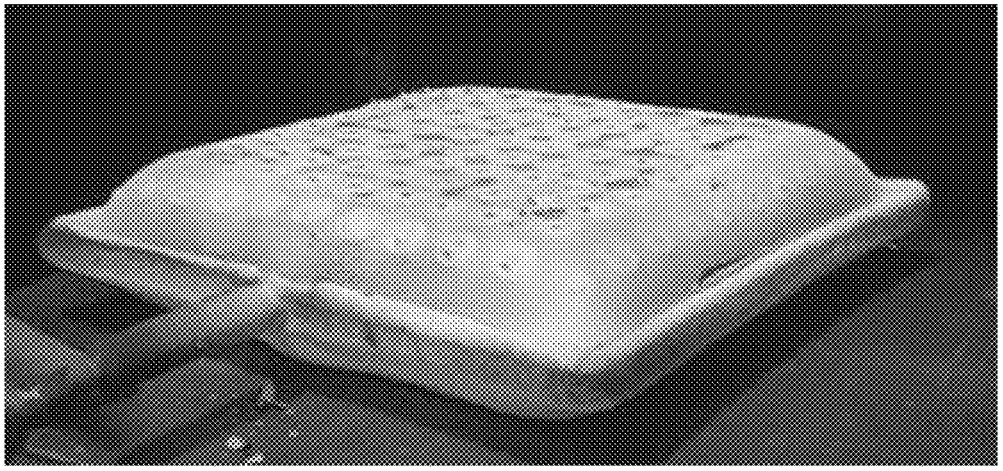
FIG. 12B shows a full-welded sheet pack after forming of the conformable pressure vessel storage tank, in accordance with one embodiment of the present invention.

FIG. 12A shows a skip-weld sheet pack after forming of the conformable pressure vessel storage tank, in accordance with one embodiment of the present invention. FIG. 12B shows a full-welded sheet pack after forming of the conformable pressure vessel storage tank, in accordance with one embodiment of the present invention.

Figure 13:
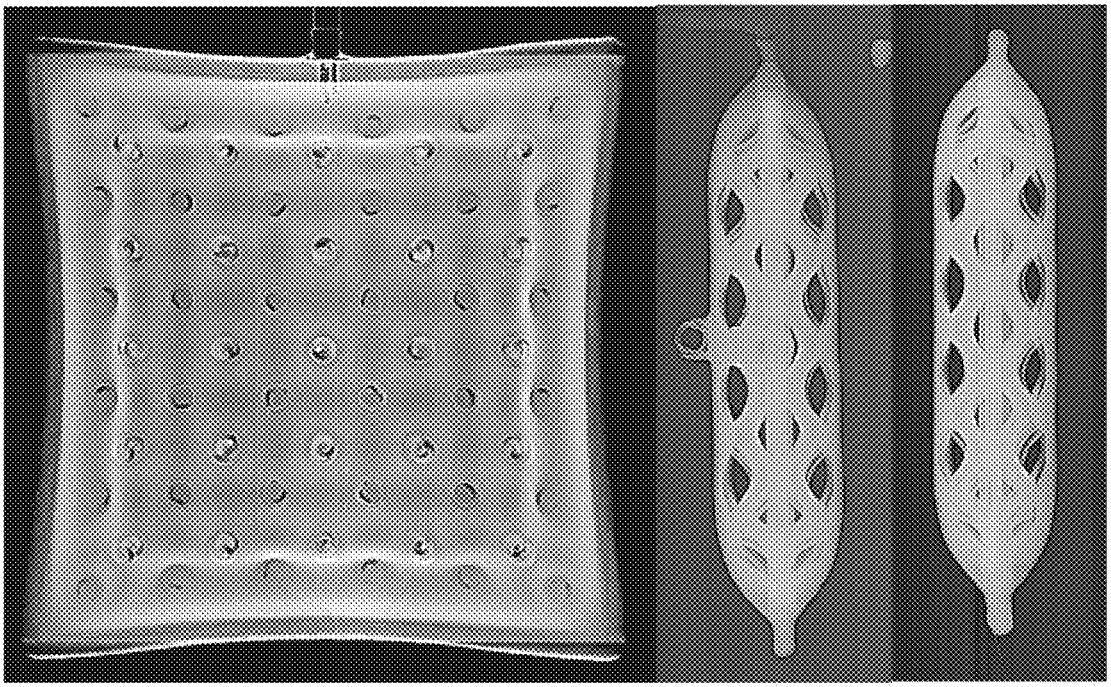
FIG. 13 is an x-ray of an internal structure for a conformable pressure vessel storage tank formed with a four layer skip-welded intermediate formed tank, in accordance with one embodiment of the present invention.

Post forming analysis and burst testing. X-ray analysis of the fabricated tanks was performed for determining the internal structure and the weld integrity between the internal sheets and the outer walls. FIG. 13 illustrates the structure formed with a four layer skip-welded intermediate formed tank. The structure formed to the modeled shape in FIG. 9A. Looking at the top orthogonal view, the darker areas around the circular welds indicate thinner material areas as also predicted by the models.

Figure 14:
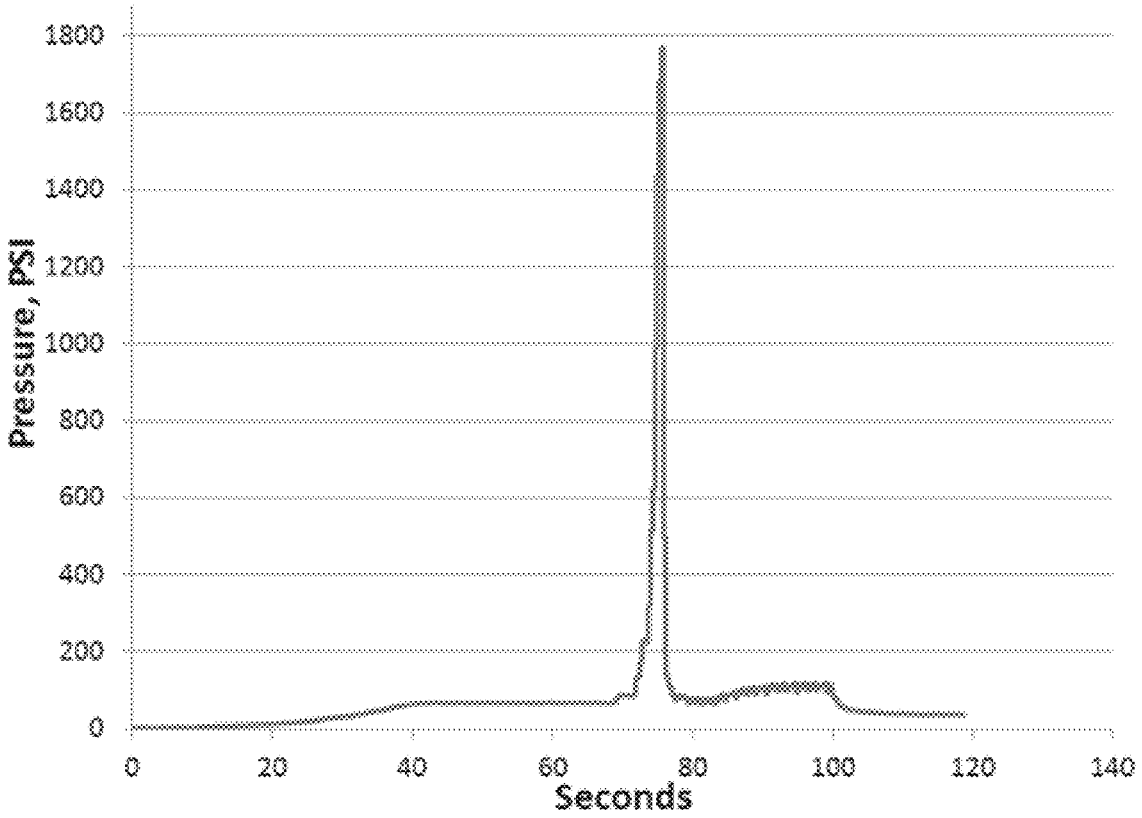
FIG. 14 is a graph showing burst test results of the skip-welded four layer sheet pack of FIG. 13. The maximum pressure is 1780 psi.

The tank subjected to x-ray analyzed in FIG. 13 was burst tested. The burst pressure reached nearly 1800 psi with a rapid increase in pressure of about three seconds, as shown in the graph of FIG. 14. The tank did not actually burst but developed leaks around some of the welds on the surface of the tank. The weld pattern and sheet thicknesses of the tank in FIG. 13 were designed to give a burst pressure of 62.5 bar× 2.25=140.6 bar (=2040 psi).

Figure 15:
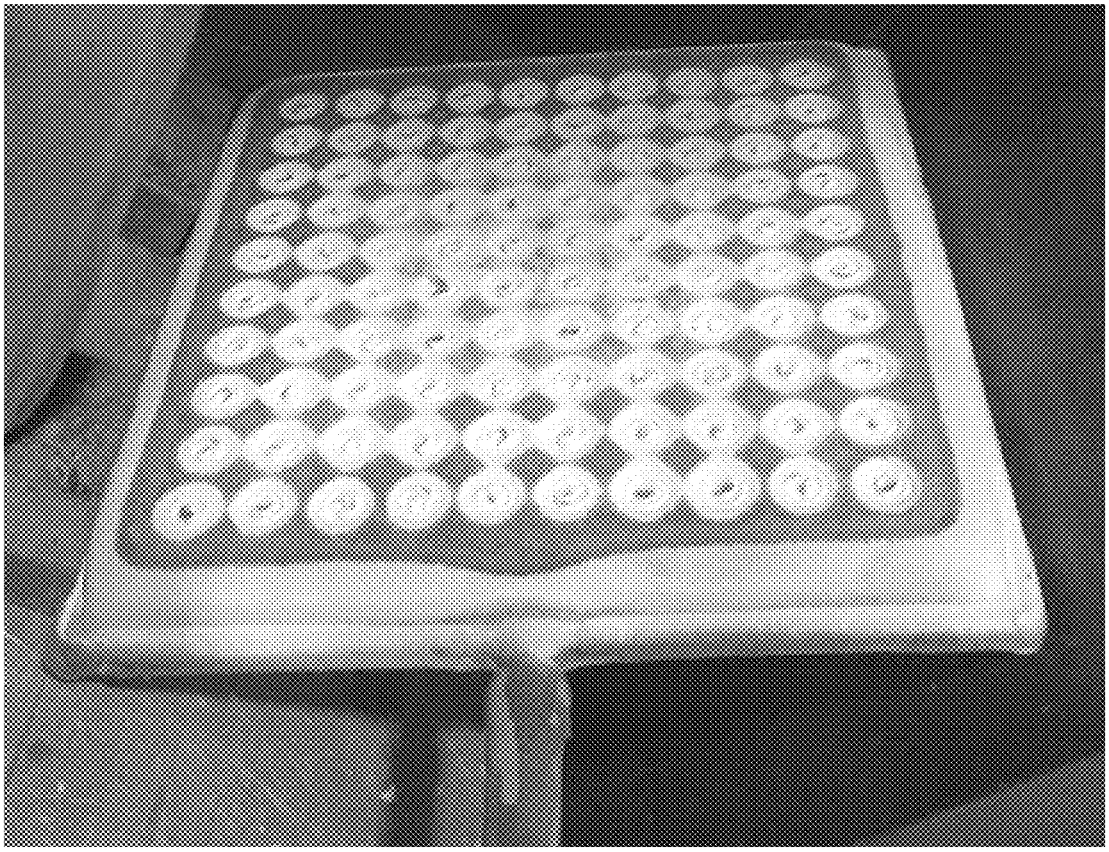
FIG. 15 shows a four sheet, full-weld, conformable pressure vessel storage tank, in accordance with one embodiment of the present invention.
Figure 16:
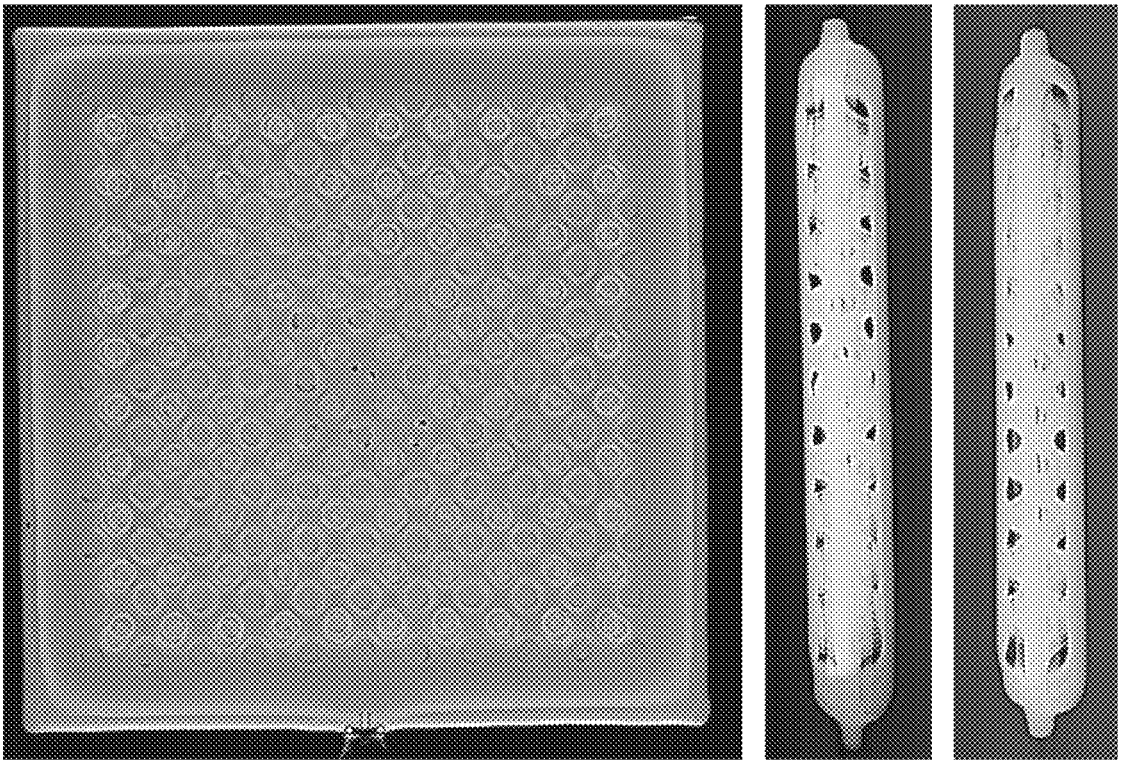
FIG. 16 is the x-ray of the four sheet, full-weld, conformable pressure vessel storage tank of FIG. 15.

The weld pattern and sheet thicknesses of the full-weld tank design, as shown in FIG. 15 were sized for a burst pressure of 250 bar×2.25=562.5 bar (=8160 psi). FIG. 16 is the x-ray of the 4-sheet, 250 bar, full-weld, tank design.

It should be noted that alternative materials can be incorporated into the above-mentioned tank designs. High ductility SPF alloys of alumni and/or stainless steel are applicable to other applications, including lower pressure tanks for absorbed natural gas storage. These alternative approaches would work towards larger volumes and additional internal layers.

REFERENCES

Altan, T., and Tekkaya, A. 2012. "Sheet Metal Forming Processes and Applications." ASM International. Materials Park, Ohio.

Cheng, J. H. 1996. The determination of material parameters from superplastic inflation tests. Journal of Materials Processing Technology. 58 (1996) 233-246. Elsevier Sciences.

Dykstra, Bill. 2001. "Hot Metal Gas Forming for Manufacturing Vehicle Structural Components." *MetalForming*: September 2001, p. 30-32.

Gardner, Bruce R. 2001. "The Business Case for the Use of Hot Metal Gas Forming." *MetalForming*: October 2001, p. 36-37.

He, Zhu-bin, Bu-gang Teng, Chang-yong Che, Zhi-biao Wang, Kai-lun Zheng, Shi-jian Yuan. 2012. "Mechanical properties and formability of TA2 extruded tube for hot metal gas forming at elevated temperature." Transactions of Nonferrous Metals Society of China, Volume 22, Supplement 2, December 2012, Pages s479-s484, ISSN 1003-6326.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

We claim:

1. A non-cylindrical pressure vessel storage tank comprising:

a. an internal structure, coupled to an inner surface of at least one wall of the storage tank, to shape and internally support the storage tank; and b. a conformability in a range of about 0.8 to 1.0;

wherein the internal structure is a Schwarz-P structured shape capped as an internal reinforcement lattice.

2. A non-cylindrical pressure vessel storage tank comprising:

a. an internal structure, coupled to an inner surface of at least one wall of the storage tank, to shape and internally support the storage tank; and b. a conformability in a range of about 0.8 to 1.0, wherein the storage tank is rated for a pressure of approximately 25 MPa and is independent of contents, with a gravimetric efficiency of approximately 1 L/kg (stored volume divided by tank mass) or greater and a volumetric efficiency of approximately 4.6 L(storage)/L(material) or greater.

3. The pressure vessel storage tank of claim 2, wherein when the storage tank contains stored compressed natural gas, the storage tank has:

a. a gravimetric energy density of approximately 8.0 MJ/Kg or greater; and b. a volumetric energy density of approximately 5.8 MJ/L or greater.

4. The pressure vessel storage tank of claim 3 wherein the stored compressed natural gas has a pressure of approximately 25 MPa, a temperature of approximately 15° C., a density of approximately 0.184 kg/L, and a specific energy of approximately 9.2 MJ/L.

5. The pressure vessel storage tank of claim 2 wherein the internal structure is a reinforcement structure.

6. The pressure vessel storage tank of claim 5 wherein the reinforcement structure is a high surface area to volume structured shape or a carbon fiber ligament structure.

7. The pressure vessel storage tank of claim 6 wherein the high surface area to volume structured shape is a Schwarz-P structured shape or an egg-crate shaped structure.

8. The pressure vessel storage tank of claim 7 wherein the Schwarz-P structured shape is capped as an internal reinforcement lattice.

9. The pressure vessel storage tank of claim 2 wherein the internal structure is designed and used to control temperature or heat transfer with the contents within the tank.

10. The pressure vessel storage tank of claim 6 wherein the carbon fiber ligament structure spans the interior of the tank in three dimensions.

11. The pressure vessel storage tank of claim 2 wherein the tank stores at least one of the following: compressed natural gas (CNG), hydrogen, and chemical or compressed energy.

12. The pressure vessel storage tank of claim 2 wherein the internal structure is made of one or more of the following materials: metals, polymers, composites, and combinations thereof.

13. The pressure vessel storage tank of claim 2 wherein the storage tank has a rated pressure of up to about 250 bar with 0.9 to 1.0 conformability.

14. The pressure vessel storage tank of claim 2 wherein the storage tank withstands internal pressures from about 350 bar to about 700 bar.

* * * * *